US005249501A

United States Patent [19]

Waldman et al.

[11] Patent Number: 5,249,501

[45] Date of Patent: Oct. 5, 1993

[54] VISUALIZATION DEVICE FOR NEAR-IR LASER DESIGNATOR

[75] Inventors: Gary Waldman; John R. Wootton, both of County of St. Louis, Mo.

[73] Assignee: Electronics & Space Corp., St. Louis, Mo.

[21] Appl. No.: 861,624

[22] Filed: Apr. 1, 1992

[51] Int. Cl.[5] ..... F41G 3/00

[52] U.S. Cl. ..... 89/41.06; 356/152

[58] Field of Search ..... 42/103; 89/41.06; 250/341, 342; 358/113; 362/110; 356/152

[56] References Cited

U.S. PATENT DOCUMENTS

| | | | |
|---|---|---|---|
| 3,327,120 | 6/1967 | Weiss | 250/342 |
| 3,659,948 | 5/1972 | De Lang | 356/152 |
| 4,311,385 | 1/1982 | Keene | 356/152 |
| 4,798,462 | 1/1989 | Byren | 356/152 |

OTHER PUBLICATIONS

Hausmann et al, Physics, 1939, pp. 604-608, 649-651.

*Primary Examiner*—Stephen C. Bentley

*Attorney, Agent, or Firm*—Polster, Lieder, Woodruff & Lucchesi

[57] ABSTRACT

A tracking system (10) is for use in a weapons system (W). The tracking system is used to assist a gunner (G) in designating and tracking a target which the gunner can fire upon using a weapon under his control. A laser (12) operating at a wavelength beyond the visible band (i.e., 70.7 um) projects a laser beam (B) at the target which illuminates a portion of the target struck by the beam. The laser is boresighted with the weapon and moves with it as the gunner tracks the target. A curved window is interposed between the laser and the target. The window (16) passes a portion of the incident laser beam on it for the laser beam to strike the target. The window also reflects a portion of the laser beam. The amount of the laser beam passing through the window is substantially greater than the portion reflected. The reflected portion of the laser beam reflects at an angle ($\theta$) with respect to the incident beam. A sensing element (26) upon which the reflected portion of the beam impinges emits a visible spot of light. The sensing element is at, or near, the focal point of the window. A visible, virtual image of the target, which is at, or near, infinity, is now created. This visible image is observable by the gunner. The gunner maintains the laser beam on the target by moving his weapon as the target moves. Movement of the laser beam produces a corresponding movement of the virtual image.

35 Claims, 1 Drawing Sheet

VISUALIZATION DEVICE FOR NEAR-IR LASER DESIGNATOR

BACKGROUND OF THE INVENTION

This invention relates to visualization devices for use in weapon's systems and, more particularly, to a visualization device for a near-IR laser designator.

Near-infrared (IR) lasers, which operate in the 0.8 um.–1.5 um. range, are used in some weapons systems as target designators and rangers. That is, the laser projects a beam of light at a target to illuminate the target or range upon it. In turn, this allows a gunner to train his weapon on the spot of light produced by the laser beam striking the target. If the laser is boresighted with the weapon, it can be used by the gunner as an aiming mark. Although the gunner can be fitted with goggles or other devices sensitive to the wavelength of the laser, these encumber the gunner and are therefore unsatisfactory. What is required is a solution which 1) is easy for an operator to use, 2) provides the operator freedom to move his head without incurring parallax errors, 3) works well in a high vibration environment, 4) is easily visible to the operator, and 5) does not require high power levels to transmit energy all the way to a target and back. This invention solves the above problems by using a small percentage of backscatter of the laser energy as it passes through an object. The backscattered energy impinges upon a medium which emits visible light in response to being irradiated with the laser energy. By placing the medium at a focal point of the object, a virtual image is created. This image is at, or near, infinity along the projected laser beam line. Because the image is at infinity, there is no parallax. Further, because of the interaction of the laser beam with the object, any movement (vibration) of the object relative to the laser or the medium does not produce any shift in the virtual image. Similarly, any movement in the medium does not result in any shift of the image.

SUMMARY OF THE INVENTION

Among the several objects of the present invention may be noted the provision of a visualization device for use as a target designator in a weapons system, the device projecting a spot of light into a scene including the target; the provision of such device which employs a laser operating in the near infrared portion of the light spectrum and which converts this longer wavelength light to provide an image in the visible portion of the spectrum; the provision of such a device which employs a window/reflector and an infrared sensor for producing a visible spot of light which a gunner can use to designate a target; the provision of such device which produces the light so it can be seen by the gunner with his unaided vision or using special vision devices such as night goggles; the provision of such a device which eliminates parallax; the provision of such a device which is inherently immune from vibrations so the gunner has a stable platform at all times and in all operational environments; the provision of such a device in which the reflector is of a material which reflects only a small portion of the incident laser beam in order for the device to provide the light spot used by the gunner; the provision of such a device which utilizes off-the-shelf components; and, the provision of such a device which is a low cost optical system that is easy to use and with which the gunner is readily trained.

In accordance with the invention, generally stated, a tracking system is for use in a weapons system, or any aiming system using longer infrared wavelengths. The tracking system is used to assist a gunner in designating and tracking a target which the gunner can fire upon using a weapon under his control. A laser projects a laser beam at the target which illuminates a portion of the target struck by the beam. The laser is boresighted with the weapon and moves with it as the gunner tracks the target. A window is interposed between the laser and the target. The window passes a portion of the incident laser beam on it for the laser beam to strike the target. The window also reflects back a portion of the laser beam. The amount of the laser beam passing through the window is substantially greater than the portion reflected. Further, the reflected portion of the laser beam is reflected at an angle with respect to the incident beam. A sensing element upon which the reflected portion of the beam impinges produces a visible spot of light observable by the gunner. The gunner maintains the laser beam on the target by moving his weapon as the target moves. Movement of the target corresponds to movement of the spot of light on the sensing element. Other objects and features will be in part apparent and in part pointed out hereinafter.

BRIEF DESCRIPTION OF THE DRAWINGS

Corresponding reference characters indicate corresponding parts throughout the drawings.

DESCRIPTION OF A PREFERRED EMBODIMENT

Figure 2:
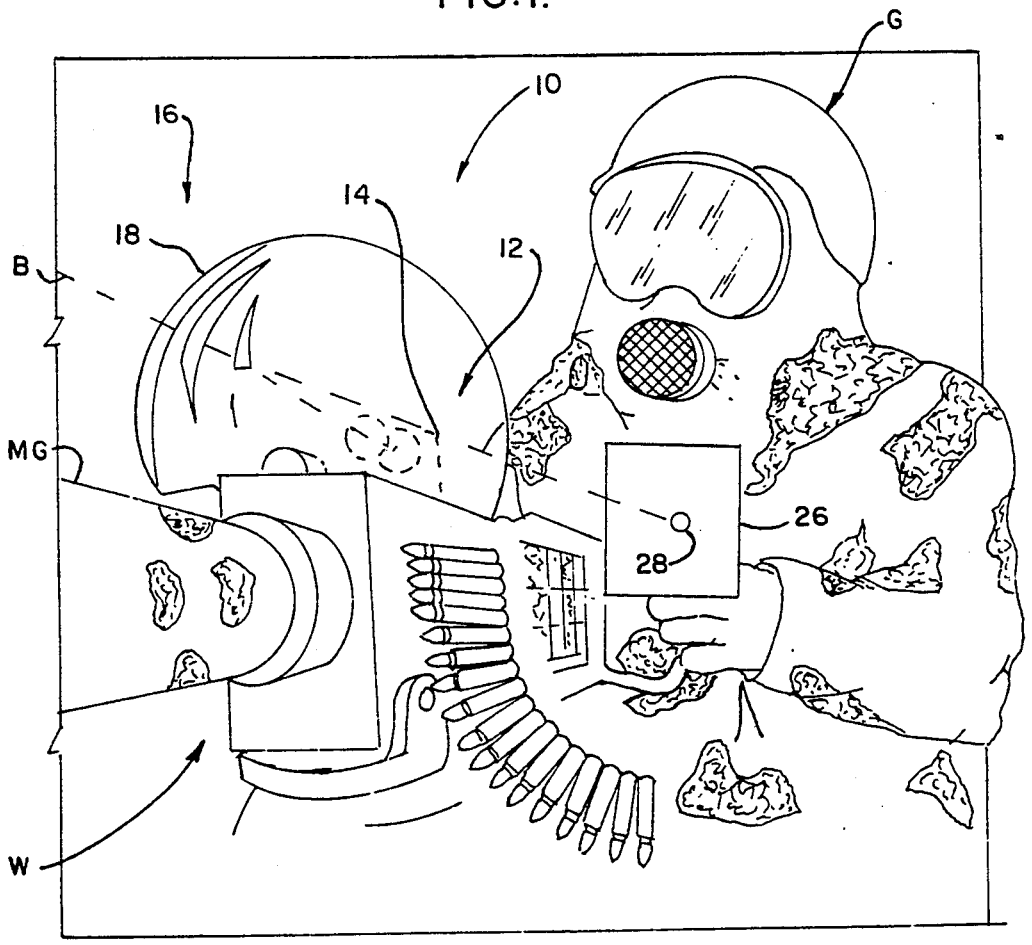

Referring to the drawings, apparatus 10 of the present invention comprises a targeting system for use with a weapon W. As shown in FIG. 2, the weapon comprises a machine gun MG. However, it will be understood that the machine gun is for illustrative purposes only, and that the invention can be practiced with other weapons, or weapon systems, as well. The machine gun, or other weapon, is operated by a gunner G who designates a target (not shown) by, in the case of the machine gun, pointing it at the target. He then tracks the target by moving the muzzle of the weapon with the target as it moves. In battlefield situations, where the target may be obscured by dust, smoke, etc., it is desirable to be able to range or designate the target with longer wavelength laser beams. Further, it is also desirable that the targeting and tracking be done so that if, for example, the machine gun were mounted on a movable platform such as a personnel carrier, tank, or helicopter, the targeting and tracking would not be effected by vibrations, shock, etc.

To accomplish this, the targeting system 10 of the present invention first includes means 12 for projecting a beam B of long wavelength coherent light at the target. Means 12 includes a laser beam generator 14 for projecting a laser beam at the target. The laser beam can be in the near infrared portion of the light spectrum; i.e. it generates a light beam having a wavelength of 0.8 um.–1.5 um. It will be understood that lasers operating in other portions of the light spectrum can also be used. For safety reasons, for example, the laser may have a wavelength greater than 1.5 um. The principles discussed herein, apply however to whatever wavelength laser is used. The laser beam illuminates the portion of the target which it strikes. As shown in FIG. 2, the laser beam generator is mounted on the machine gun. Consequently, it is movable by the gunner as he moves the weapon in tracking the target. Preferably, laser beam generator 14 is boresighted with the machine gun.

Next, a window means 16 is interposed between the laser beam projector and the target. Means 16 passes a portion of the impinging laser beam through to the target, and reflects back the remainder of the beam. The amount of the beam passing through the window means is substantially greater than that reflected. Means 16 includes a spherically shaped window 18 which is, for example, approximately 40 cm.–50 cm. in diameter. The window is concave in form and is either fabricated of, or its inner and outer surfaces, 20*i* and 20*o* respectively are coated with, a material which reflects approximately 1% of the laser light impinging on it. The geometry of window 18 results in a focal length of approximately 50–100 cm, for example. Again, the principles discussed herein are not constrained by focal length.

System 10 next includes sensing means 22 upon which the reflected portion of the laser beam impinges. Means 22 includes an infrared sensor card 26. Card 26 is a commercially available electron trap, upconverting device which is energized either by exposure to daylight or to fluorescent light. The card is responsive out to 1.6 um. For other, longer wavelengths, similar upconverters are available. In addition, these commercially available cards have signal rise and decay times which are on the order of 10 nsec. As a result, the system can respond rapidly to beam motion on the card resulting from any vibration. This is also advantageous because it prevents depletion of the stored energy at any one location on the card.

Figure 1:
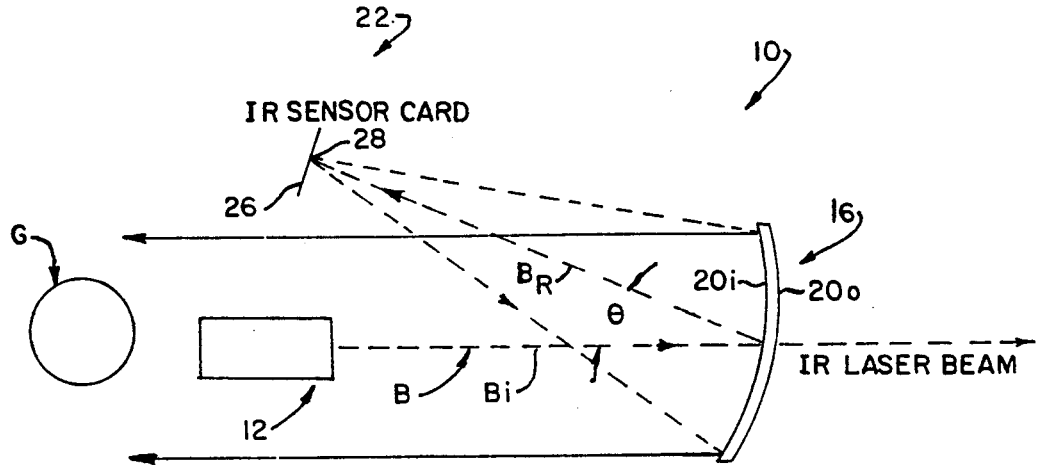
FIG. 1 is a schematic representation of the tracking system of the present invention; and, FIG. 2 is an illustration of the tracking system in use with a weapon.

The card is positioned off-axis with respect to the axis of the laser beam projector. As seen in FIG. 1, reflected beam Br is reflected at an angle $\theta$ with respect to the incident beam Bi. Angle $\theta$ is preferably between 10° and 15°. When the reflected laser beam strikes card 26 it produces a spot 28 of light which is observable by gunner G. The spot 28 of light is in the visible portion of the spectrum. The spot of light is reflected onto surface 20*i* of the window so to be observable by the gunner. By maintaining the spot of light on the image of the target, he can track the target. And, he can do this with his unaided eye, or, if appropriate, with night goggles.

The effect of system 10 is to produce a virtual image of the target object using a laser operating at a wavelength the eye cannot see. The curved, reflective mirror 18, and sensor card 26, together with the laser beam produce a psuedo image of the target in the visible band. While the real object is effectively at, or near, infinity, from an optics point of view, the gunner is nevertheless able to track it using by its virtual image. This has a number of advantages, a primary one of which is elimination of parallax.

Of particular importance, system 10 is inherently immune to vibrations associated with the weapon's platform. This is because, as ray tracing demonstrates, the image of the light spot 28 is congruent with the laser beam. This is because the double pass of the beam with respect to the concave window/reflector, first from the laser to card 26, and then from the spot on the card to the gunner. It will be understood that, as shown in FIG. 2, gunner G uses the system by observing the target through window 18. If he looks around the window, the spot disappears from his view.

What has been described is a low cost, simple, easy to use system which is employed with a wide variety of weapons to enable the user of the weapon to readily designate and track a target. This despite smoke, dust, and any platform vibrations which the system may experience.

In view of the foregoing, it will be seen that the several objects of the invention are achieved and other advantageous results are obtained.

As various changes could be made in the above constructions without departing from the scope of the invention, it is intended that all matter contained in the above description or shown in the accompanying drawings shall be interpreted as illustrative and not in a limiting sense.

Having thus described the invention, what is claimed and desired to be secured by letters patent is:

1. Apparatus for use in a weapons system by a gunner to designate a target comprising:

means for projecting a beam of light at the target, the beam projecting means being movable by the gunner;

window means interposed between the beam projecting means and the target, said window means passing a portion of the light beam therethrough and reflecting a portion of the light beam, the amount of the light beam passing through the window means being substantially greater than the portion reflected; and, sensing means upon which the reflected portion of the beam impinges, the reflected beam producing a spot of light where it strikes the sensing means, said spot of light being observable as a virtual image of the target by the gunner who, in turn, can maintain the projected beam of light on the target by moving the light projecting means as the target moves and following the corresponding movement of the virtual image.

2. The apparatus of claim 1 wherein the light beam projecting means comprises means for projecting a long-wavelength, non-visible laser beam at the target.

3. The apparatus of claim 2 wherein the projecting means includes means for projecting a laser beam in the near infrared portion of the light spectrum.

4. The apparatus of claim 2 wherein the weapons system includes a weapon for firing at the target, and the light projecting means being connected to and boresighted with the weapon for the gunner to move the light projecting means when the weapon is moved.

5. The apparatus of claim 4 wherein the window means comprises a spherical shaped window formed of a material which reflects back approximately 1% of the light impinging on it.

6. The apparatus of claim 5 wherein the sensing means includes an infrared sensor card positioned off-axis with respect to the axis of the light projecting means.

7. The apparatus of claim 6 wherein the sensor card is positioned between approximately 10°–15° off axis.

8. The apparatus of claim 5 wherein the window is approximately 40–50 cm. in diameter.

9. The apparatus of claim 8 wherein the window has a focal length of approximately 50–100 cm.

10. The apparatus of claim 6 wherein the sensor card is an electron trap, upconverting device which is energized by exposure to daylight and fluorescent light.

11. A tracking system for use in a weapons system to assist a gunner in designating a target to be fired upon by a weapon controlled by the gunner comprising:

laser means for projecting a laser beam at the target, the laser means being boresighted with the weapon and movable therewith by the gunner to track the target;

window means interposed between the laser means and the target for passing a portion of an incident laser beam through the window means and for reflecting a portion of the laser beam, the amount of the laser beam passing through the window means being substantially greater than the portion reflected, and the reflected portion of the laser beam being reflected at an angle with respect to the incident beam; and, sensing means upon which the reflected portion of the beam impinges to produce a visible spot of light observable by the gunner as a virtual image of the target, the gunner maintaining the laser beam on the target by moving his weapon as the target moves, movement of the laser beam producing a corresponding movement of the virtual image.

12. The system of claim 11 wherein the laser means produces a laser beam in the near infrared portion of the light spectrum.

13. The system of claim 12 wherein the window means includes a spherically shaped window formed of a laser beam reflecting material which reflects back approximately 1% of the laser beam impinging on it.

14. The system of claim 11 wherein the window is approximately 40–50 cm. in diameter and has a focal length of approximately 50–100 cm.

15. The system of claim 11 wherein the sensing means includes an infrared sensor card positioned off-axis with respect to the axis of the laser beam projecting axis of the laser means.

16. The system of claim 15 wherein the sensor card is an electron trap, upconverting device energized by exposure to daylight and fluorescent light, and positioned between approximately 10°–15° off axis.

17. A method of designating and tracking a target by a gunner:

controlling by the gunner a weapon which can be fired at the target;

projecting a laser beam at target to designate it as such, said gunner moving said laser beam as said target moves;

impinging the laser beam on a window means interposed between the laser beam generating means and the target, passing a portion of an impinging laser beam through the window means and reflecting a portion of the laser beam at an angle with respect to the impinging beam, the amount of the laser beam passing through the window means being substantially greater than the portion reflected;

sensing the reflected portion of the laser beam on a sensing means; and, producing on the sensing means a visible spot of light which is observable by the gunner as a virtual image, the gunner tracking the target by moving his weapon as the target moves, movement of the laser beam producing a corresponding movement of the virtual image.

18. The method of claim 17 further including boresighting the laser beam generating means with the weapon.

19. The method of claim 18 further including offsetting the reflected laser beam from the impinging beam.

20. The method of claim 19 further including offsetting the reflected laser beam by approximately 5°–10° from the impinging beam.

21. A system for producing an image representing an object comprising:

means for generating and transmitting a beam of light at the object, said beam of light being in the non-visible portion of the light spectrum;

reflectance means interposed between said beam generating means and said object, said reflectance means reflecting a portion of said transmitted beam and passing the rest thereof, the portion of said beam passed through the reflectance means being substantially greater than the portion reflected; and, means for sensing the reflected portion of said beam and for producing a visible spot of light in response thereto, said visible spot of light being an image representative of the object.

22. The system of claim 21 wherein said light generating means comprises means for generating a laser beam whose wavelength is in the infrared portion of the light spectrum.

23. The system of claim 22 wherein the reflectance means comprises a curved window, the curvature of the window defining a focal point at which the sensing means is positioned, whereby the object is located at, or near, infinity with respect to the optical characteristics of the system, and the virtual image is produced at the focal point.

24. The system of claim 23 wherein the sensing means comprises an electron trap, upconverting device.

25. Apparatus for use in a weapons system by a gunner to designate a target comprising:

means for projecting a beam of light at the target, the beam projecting means being movable by the gunner and comprising means for projecting a long-wavelength, non-visible laser beam at the target, the weapons system including a weapon for firing at the target, the light projecting means being connected to and boresighted with the weapon for the gunner to move the light projecting means when the weapon is moved;

window means interposed between the beam projecting means and the target, said window means comprising a spherical window passing a portion of the light beam therethrough and reflecting a portion of the light beam, the window being formed of a material which reflects back approximately 1% of the light impinging upon it whereby the amount of light passing through the window means is substantially greater than the portion reflected; and, sensing means upon which the reflected portion of the beam impinges, the reflected beam producing a spot of light where it strikes the sensing means, said spot of light being observable as a virtual image at the target by the gunner who, in turn, can maintain the projected beam of light on the target by moving the light projecting means as the target moves and following the corresponding movement of the virtual image.

26. The apparatus of claim 25 wherein the sensing means includes an infrared sensor card positioned off-axis with respect to the axis of the light projecting means.

27. The apparatus of claim 25 wherein the sensor card is positioned between approximately 10°-15° off axis.

28. The apparatus of claim 25 wherein the window is approximately 40-50 cm. in diameter.

29. The apparatus of claim 25 wherein the window has a focal length of approximately 50-100 cm.

30. The apparatus of claim 25 wherein the sensor card is an electron trap, upconverting device which is energized by exposure to daylight and fluorescent light.

31. A tracking system for use in a weapons system to assist a gunner in designating a target to be fired upon by a weapon controlled by the gunner comprising:

laser means for producing a laser beam in the near infrared portion of the light spectrum and for projecting the laser beam at the target, the laser beam being boresighted with the weapon and moveable therewith by the gunner to track the target;

window means interposed between the laser means and the target for passing a portion of the incident laser beam through the window means and for reflecting a portion of the laser beam, the amount of laser beam passing through the window means being substantially greater than the portion reflected, and the reflected portion of the laser beam being reflected at an angle with respect to the incident beam, the window means including a spherically shaped window formed of a laser beam reflecting material which reflects back approximately 1% of the laser beam impinging on it; and, sensing means upon which the reflected portion of the beam impinges to produce a visible spot of light observable by the gunner as a virtual image of the target, the gunner maintaining the laser beam on the target by moving his weapon as the target moves, movement of the laser beam producing a corresponding movement of the virtual image.

32. The system of claim 31 wherein the window is approximately 40-50 cm. in diameter and has a focal length of approximately 50-100 cm.

33. The system of claim 31 wherein the sensing means includes an infrared sensor card positioned off-axis with respect to the axis of the laser beam projecting axis of the laser means.

34. The system of claim 33 wherein the sensor card is an electron trap, upconverting device energized by exposure to daylight and fluorescent light, and positioned between approximately 10°-15° off axis.

35. A method of designating and tracking a target by a gunner comprising:

controlling by the gunner a weapon which can be fired at the target;

projecting a laser beam at a target to designate it as such, said gunner moving said laser beam as said target moves, including boresighting the laser beam generating means with the weapon;

impinging the laser beam on a window beam interposed between the laser beam generating means and the target, passing a portion of an impinging laser beam through the window means and reflecting a portion of the laser beam at an angle with respect to the impinging beam, including offsetting the reflected laser beam from the impinging beam by approximately 50-100 from the impinging beam, the amount of the laser beam passing through the window means being substantially greater than the portion reflected;

sensing the reflected portion of the laser beam on a sensing means; and, producing on the sensing means a visible spot of light which is observable by the gunner as a virtual image, the gunner tracking the target by moving his weapon as the target moves, movement of the laser beam producing a corresponding movement of the virtual image.

* * * * *